US005162627A

United States Patent [19]

Dufournet et al.

[11] Patent Number: 5,162,627

[45] Date of Patent: Nov. 10, 1992

[54] MEDIUM OR HIGH TENSION CIRCUIT BREAKER HAVING ABUTTING ARCING CONTACTS

[75] Inventors: Denis Dufournet, Bron; Bernard Joyeux-Bouillon, Bage le Chatel; Jean Maineult, Ceyzeriat; Michel Perret, Bourgoin-Jallieu, all of France

[73] Assignee: GEC Alsthom SA, Paris, France

[21] Appl. No.: 685,314

[22] Filed: Apr. 15, 1991

[30] Foreign Application Priority Data

Apr. 25, 1990 [FR] France ..... 90 05263

[51] Int. Cl.[5] ..... H01H 33/42; H01H 33/88

[52] U.S. Cl. ..... 200/148 A; 200/148 B; 200/148 R

[58] Field of Search ..... 200/148 R, 148 A, 148 B, 200/148 D, 148 F, 148 G, 148 H, 150 G

[56] References Cited

U.S. PATENT DOCUMENTS 3,639,712 2/1972 Balmat et al. ..... 200/148 A
3,763,340 10/1973 Noack ..... 200/148 D
4,489,226 12/1984 Holmgren et al. ..... 200/148 A
4,945,197 7/1990 Thuries et al. ..... 200/148 A
5,001,314 3/1991 Thuries et al. ..... 200/148 B

FOREIGN PATENT DOCUMENTS 1458334 10/1966 France .
2174838 10/1973 France .

*Primary Examiner*—J. R. Scott
*Attorney, Agent, or Firm*—Sughrue, Mion, Zinn, Macpeak & Seas

[57] ABSTRACT

A high tension or medium tension circuit breaker having abutting arcing contacts. The circuit breaker includes a gastight insulating case filled with a gas having good dielectric properties. The case contains a stationary arcing contact; a moving arcing contact driven by a drive rod actuated by a mechanism outside the case. A blast chamber is defined by a piston integral with the moving arcing contact, slidably received in a fixed cylinder terminating in a blast nozzle, the cylinder and a ring. The circuit breaker further includes a lost motion mechanism to enable the drive rod to move over a given length in the circuit breaker opening direction without driving the moving arcing contact away from the fixed arcing contact.

2 Claims, 4 Drawing Sheets

MEDIUM OR HIGH TENSION CIRCUIT BREAKER HAVING ABUTTING ARCING CONTACTS

The present invention relates to a circuit breaker having abutting arcing contacts, and usable at medium tension or at high tension.

BACKGROUND OF THE INVENTION

Circuit breakers having abutting arcing contacts are known and comprise a gastight case filled with a gas having good dielectric properties such as sulfur hexaflouride, and in which the arc is blasted by gas being compressed during an opening operation. In circuit breakers of this type, the gas is compressed before the arcing contacts separate (this is referred to as "precompression"); during this precompression stage, the main contacts of the circuit breaker are opened, which main contacts may be located outside the case; the drawback of the precompression stage is that it requires considerable drive energy and this detrimental to the cost of the apparatus.

An object of the present invention is to provide a circuit breaker having abutting arcing contacts for arc blasting but requiring only a small amount of drive energy.

SUMMARY OF THE INVENTION

The present invention provides a high tension or medium tension circuit breaker having abutting arcing contacts, the circuit breaker comprising a gastight insulating case filled with a gas having good dielectric properties, and containing: a stationary arcing contact; a moving arcing contact driven by a drive rod actuated by a mechanism outside the case; a blast chamber comprising a piston integral with the moving arcing contact and slidably received in a fixed cylinder; and a blast nozzle; wherein the circuit breaker includes lost motion means to enable the drive rod to move over a given length without driving said arcing contact.

For example, said moving arcing contact is a tube, with said lost motion means comprising a slot formed in the tube and receiving an arm which is fixed to the drive rod.

In an embodiment which is preferably for use under high tension, the circuit breaker includes fixed permanent contacts mechanically and electrically connected to said fixed arcing contacts and co-operating with a tube constituting a moving permanent contact and connected to said drive rod.

BRIEF DESCRIPTION OF THE DRAWINGS

Embodiments of the invention are described by way of example with reference to the accompanying drawings, in which.

DETAILED DESCRIPTION

Figure 1:
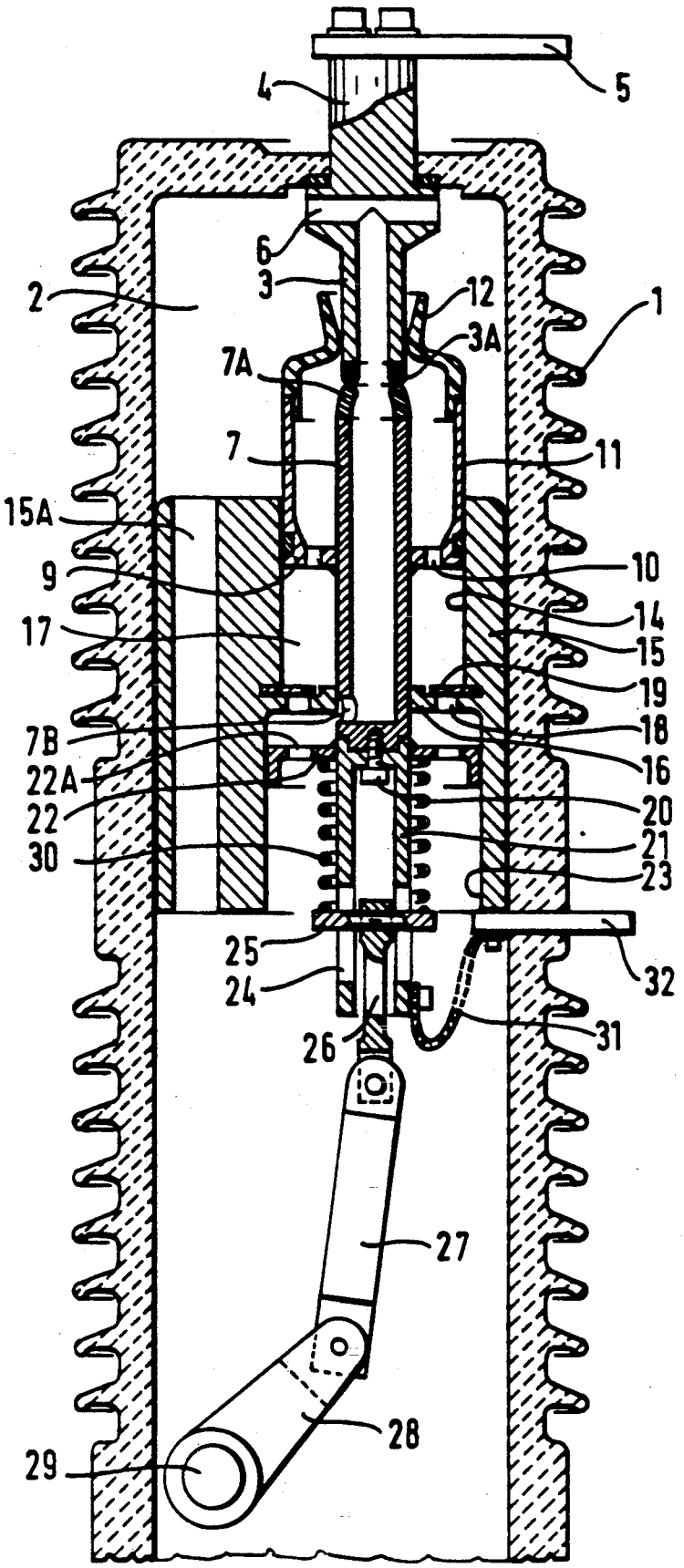
FIG. 1 is a diagrammatic axial section through a first embodiment of a circuit breaker shown in the engaged position.

In FIG. 1, reference 1 designates an insulating cylindrical case, e.g. made of porcelain, which delimits a gastight inside volume 2 that is filled with a gas having good dielectric properties such as sulfur hexafluoride, either pure or mixed with nitrogen, and under a pressure of a few bars.

The fixed arcing contact of the circuit breaker is constituted by a metal tube 3 connected to a block 4 passing through the case in gastight manner and connected to a first terminal 5. The tip 3A of the tube 3 is made of an alloy that withstands the effects of arcing, e.g. a tungsten based alloy. Inside the case 1, the block 4 is pierced by a channel 6 for facilitating gas circulation inside the case.

The moving arcing contact is constituted by a metal tube 7 whose tip 7A engages the tube 3 and is likewise made of an alloy that withstands arcing. Towards its end opposite from the tip 7A, the tube 7 has at least one transverse hole 7B for exhausting gas.

The tube 7 is integral with a blast piston 9 provided with orifices 10 and integral with a cylinder 11 carrying a blast nozzle 12 made of insulating material.

The piston 9 slides in a first bore 14 of a metal block 15 which bears against the inside face of the insulating case 1. The block 15 includes a metal ring 16 which is obtained by milling and which acts with the piston 9 and the wall of the bore 14 to delimit a blast volume 17. The ring includes a central hole (no reference) through which the tube 7 slides. In addition, the ring 16 is pierced by at least one hole 18 which is associated with a non-return valve that may be constituted merely by a flexible washer 19 to allow gas to flow only from the outside towards the inside of the volume 17.

The block 15 is pierced longitudinally by a channel 15A extending parallel to the axis of the case and putting volumes situated at opposite ends thereof into communication with each other.

The tube 7 is fixed coaxially by means of a screw 20 to a metal cylinder 21 which is fixed to an annular guide piece 22 slidably received in a counterbore 23 of the block 15.

The guide piece 22 is pierced by holes 22A.

The cylinder 21 has a radial slot 24 receiving an arm 25 which is connected to a rod 26 hinged to a connecting rod 27 of the drive mechanism, which mechanism further includes a crank 28 keyed to a rotary shaft 29 which is driven by a drive member (not shown) outside the case 1.

A coil spring 30 bearing against the ring 22 at one end and arm 25 at the other end, urges the arm 25 downwards.

The cylinder 21 is electrically connected by a braid 31 to a second terminal 32 which is fixed to the metal block 15 and which passes through the case in gastight manner.

The circuit breaker operates as follows:

In the engaged position (shown in FIG. 1), the major fraction of the electrical current passes via main contacts situated outside the case 1 and not shown, which main contacts are electrically connected in parallel with the arcing contacts and are provided with their own drive member.

The tips 3A and 7A of the arcing contacts touch one another and the spring 30 is compressed.

Figure 2:
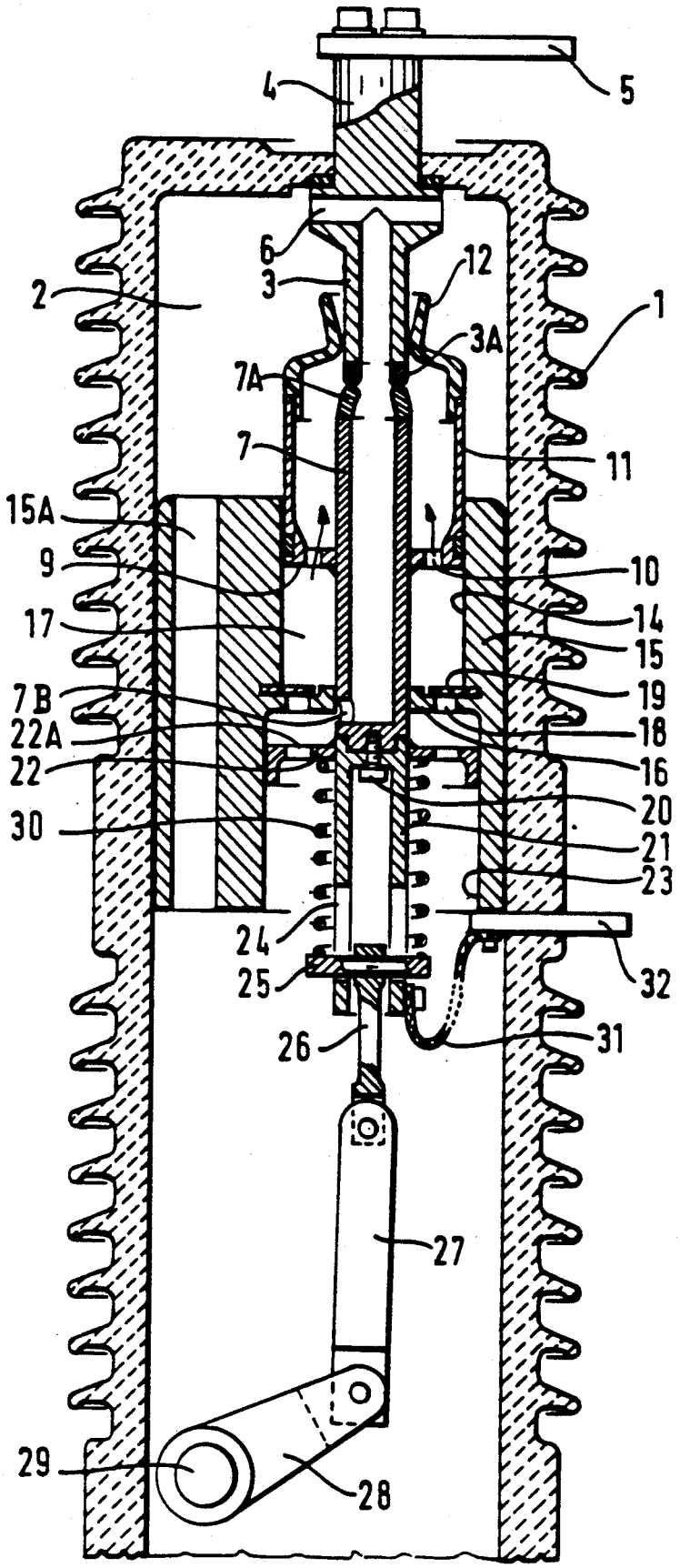
FIG. 2 is an axial section through the same circuit breaker shown at the beginning of a disengagement operation.

For opening purposes, an instruction is given to the drive member, and the shaft 29 begins to rotate clockwise. Initially, the arm 25 slides inside the slot 24 without driving the cylinders 21 and 7, and also without giving rise to any precompression in the volume 17. This operation is assisted by the spring 30 expanding. This first stage is used for causing the main contacts to open. Current then switches to the arcing contacts passing through the terminal 5, the block 4, the tube 3—3A, the tube 7—7A, the tube 21, the braid 31, and the terminal 32. FIG. 2 shows the disposition of the circuit breaker components during this first stage.

Figure 3:
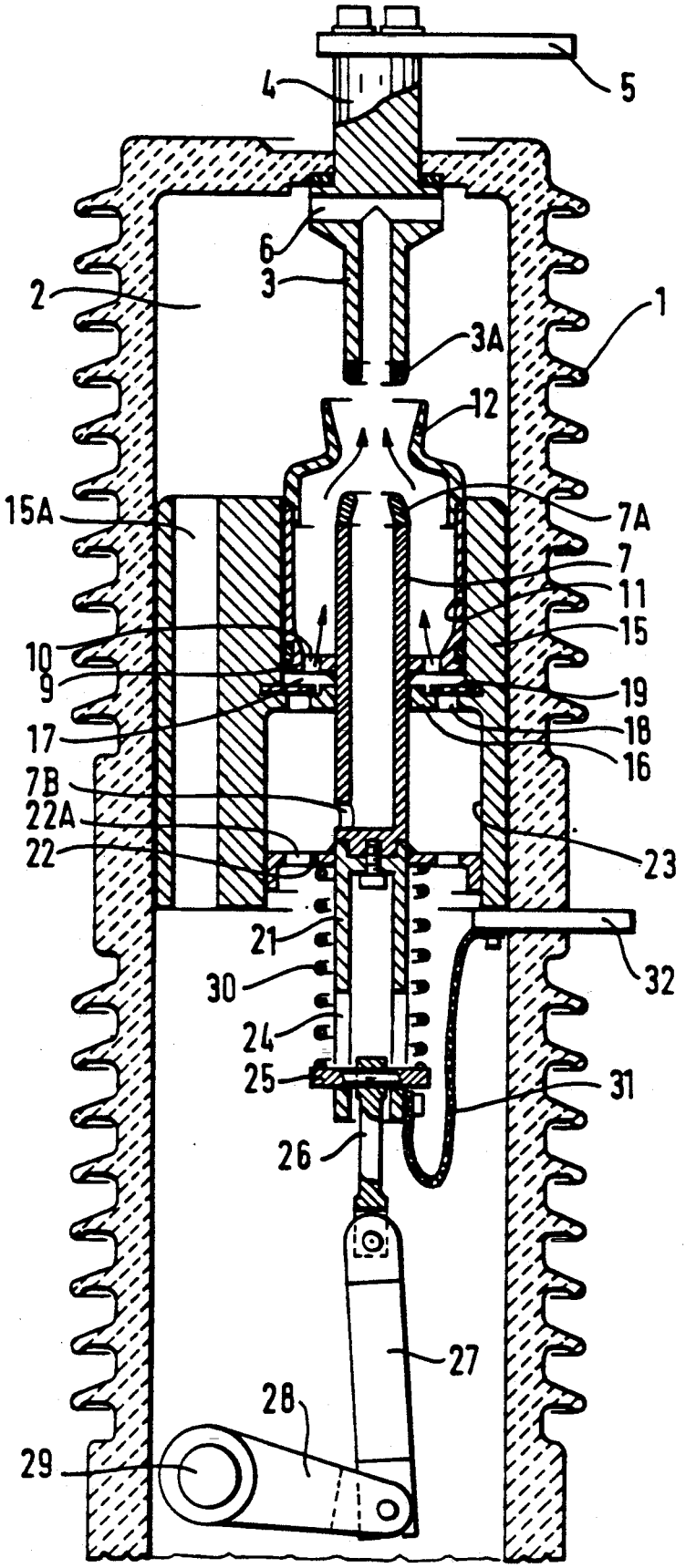
FIG. 3 is an axial section through the same circuit breaker shown at the end of a disengagement operation.

When the arm 25 reaches the end of the slot 24, the tube 21 and consequently the moving arcing contact 7—7A receives drive. An arc is struck between contact tips 3A, 7A and is blasted by the gas from the volume 17 which is compressed by displacement of the piston 9 towards underlying ring 16, which gas escapes via the nozzle 12 as soon as the passage is unobstructed. FIG. 3 shows the end of this second stage during which the gas in the volume 17 is compressed.

Because of the dispositions as described above, the amount of energy required for driving purposes is reduced since the gas is not compressed so long as an arc has not been struck. In addition, the drive rod 26 gathers speed during the first stage such that the arcing contacts separate very suddenly at the beginning of the second stage, thereby facilitating interrupting.

The embodiment described above concerns a circuit breaker (preferably for use at medium tension) in which the main contacts are disposed outside the case containing the interrupting chamber.

Figure 4:
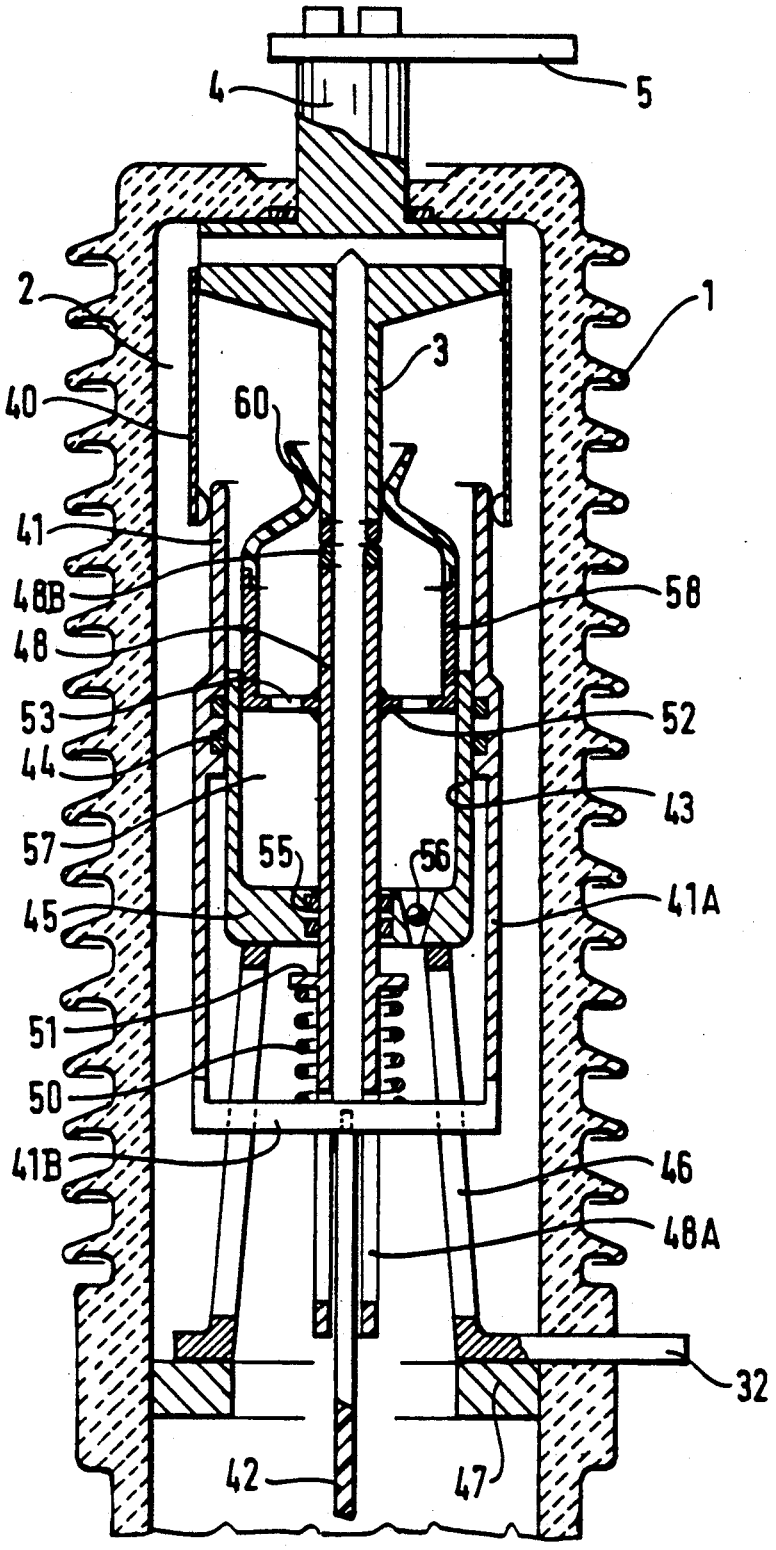
FIG. 4 is an axial section view through a second embodiment of a circuit breaker of the invention shown in the engaged position.

The variant embodiment of the invention shown in FIG. 4 relates to a circuit breaker for use at high tension in which the main contacts are placed inside the interrupting chamber.

Items which are common to FIG. 4 and to the preceding figures are designated in FIG. 4 by the same references as above.

The metal block 4 carries contact fingers 40 constituting the fixed permanent contact of the circuit breaker. The moving permanent contact is constituted by a metal tube 41 connected by arms 41A and a bar 41B to a drive rod 42 made of insulating material. The blast cylinder is a tube 43 sliding inside the tube 41 and electrically connected thereto via sliding contacts 44. The bottom 45 of the cylinder 43 is held fixed by metal arms 46 integral with a fixed metal block 47 having the insulating rod 42 passing therethrough. At least one of the arms 46 is connected to the second terminal 32. The bottom 45 of the cylinder 43 is pierced by a central hole receiving a metal tube 48 constituting the moving arcing contact and provided at one end with a tip 48B made of material that withstands the effects of arcing. This tube has a slot 48A in which the bar 41B is engaged. In addition, a coil spring 50 is disposed between the bar 41B and an abutment ring 51 on the tube 50.

A blast piston 52 integral with the moving contact 48 and provided with orifices 53 is slidably received inside the cylinder 43.

The bottom 45 of the cylinder 43 is provided with sliding contacts 55 for providing electrical connection between said bottom and the moving arcing contact. In addition, the bottom 45 is provided with a non-return valve 56 which allows gas to pass only from the outside towards the inside of the blast volume 57 which is delimited by the cylinder 43, the bottom 45, and the piston 52. The piston 52 is extended by a metal cylinder 58 which is slidably received inside the cylinder 43 and which carries a blast nozzle 60 made of insulating material.

The circuit breaker operates as follows:

In the engaged position, the circuit breaker is in the configuration shown in FIG. 4. The bar 41B is at the top of the slot 48A, the spring 50 is compressed, and the blast volume is at its maximum. Current then flows via the terminal 5, the block 4, the fingers 40, the tube 41, the sliding contacts 44, the cylinder 43, the bottom 45, the arms 46 and the terminal 32.

When an opening instruction is given, the insulating rod moves downwards in the figure. During a first stage, corresponding to the bar 41B moving along the slot 48A, only the cylinder 41 is driven, thereby separating the permanent contacts. During this stage, the piston 52 remains stationary, such that no precompression of the gas takes place.

Once the bar 41B reaches the bottom end of the slot, the tube 48 is driven downwardly, thereby separating the arcing contacts 3A and 48B, and also compressing the blast volume 57.

Here again, because of the above-described disposition, the drive energy required is low since there is no precompression prior to the arcing contacts separating. These contacts separate suddenly because of the speed acquired by the moving equipment during the first stage.

This variant embodiment is preferably for use in high tension circuit breakers.

We claim:

1. A high tension or medium tension circuit breaker having axially aligned abutting arcing contacts, the circuit breaker comprising a gastight insulating case filled with a gas having good dielectric properties, and containing:

a stationary arcing contact;

a moving, coaxial arcing contact driven by a reciprocating drive rod actuated by a mechanism outside the case;

a blast chamber defined by a piston integral with the moving arcing contact, a fixed cylinder slidably receiving said piston and a fixed ring; and a movable cylinder fixed to said blast piston and terminating at an end remote from said blast piston in a blast nozzle concentric about said stationary contact during circuit breaker closed position;

wherein the circuit breaker includes lost motion means connecting said drive rod to said moving arcing contact to enable said drive rod to move over a given length without driving said moving arcing contact, and wherein said moving arcing contact is a tube, and said lost motion means comprise a radial slot passing transversely through said tube and receiving an arm fixed to one end of the drive rod and movable freely over the length of the slot in the direction of the tube axis, thereby eliminating precompression of the gas during circuit breaker opening before the arcing contacts separate by delaying drive rod retraction of the moving arcing contact away from the stationary arcing contact.

2. A circuit breaker according to claim 1, including fixed permanent contacts mechanically and electrically connected to said fixed arcing contact and co-operating with a tube constituting a moving permanent contact and connected to said drive rod.

* * * * *